US007181901B2

(12) United States Patent
Riede

(10) Patent No.: US 7,181,901 B2
(45) Date of Patent: Feb. 27, 2007

(54) CHANNEL PLATE FOR AN OPEN-ENDED ROTOR SPINNING DEVICE

(75) Inventor: Brigitte Riede, Mönchengladbach (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 0 days.

(21) Appl. No.: 10/567,994

(22) PCT Filed: Jun. 9, 2004

(86) PCT No.: PCT/EP2004/006228

§ 371 (c)(1),
(2), (4) Date: Feb. 10, 2006

(87) PCT Pub. No.: WO2005/031050

PCT Pub. Date: Apr. 7, 2005

(65) Prior Publication Data

US 2006/0225401 A1 Oct. 12, 2006

(30) Foreign Application Priority Data

Aug. 29, 2003 (DE) ..... 103 39 875

(51) Int. Cl.
*D01H 4/08* (2006.01)

(52) U.S. Cl. ..... 57/404

(58) Field of Classification Search ..... 57/404–417
See application file for complete search history.

(56) References Cited

U.S. PATENT DOCUMENTS 4,769,984 A * 9/1988 Raasch et al. ..... 57/407
4,879,873 A 11/1989 Kawabata et al. ..... 57/413
4,903,474 A * 2/1990 Stahlecker ..... 57/413
5,491,966 A 2/1996 Billner ..... 57/413
5,581,991 A 12/1996 Billner ..... 57/413
5,749,216 A * 5/1998 Lang et al. ..... 57/413
5,937,630 A 8/1999 Wassenhoven ..... 57/407
6,035,623 A 3/2000 Wassenhoven et al. ..... 57/406

FOREIGN PATENT DOCUMENTS

DE 197 29 192 A1 1/1999
EP 301 581 A1 2/1989
EP 0 779 383 A2 6/1997

* cited by examiner

*Primary Examiner*—Shaun R. Hurley
(74) *Attorney, Agent, or Firm*—Kennedy Covington Lobdell & Hickman, LLP

(57) ABSTRACT

A channel plate for an open-end rotor spinning device for closing a rotor housing charged with underpressure in which a spinning rotor rotates, having a channel plate tower extending into the spinning rotor, in whose shell face the outlet opening of a fiber guide channel is arranged and in whose front side a yarn draw-off nozzle can be fixed. A concavely arched transition surface adjoins a cylindrical part of the shell face, and the channel plate tower has a diameter at the height of the rotor edge of the spinning rotor such that an annular gap of maximally 2 mm width between the spinning rotor and the channel plate tower results during spinning. At most one half of the outlet opening of the fiber guide channel is arranged in the area of the cylindrical shell face, and the remaining part in the arched transition surface. The wall area of the outlet opening remotest from the front side is at a distance to the center longitudinal axis of the channel plate at least 0.5 to 3 mm greater than the distance of the adjoining wall area in respect to the center longitudinal axis.

3 Claims, 5 Drawing Sheets

CHANNEL PLATE FOR AN OPEN-ENDED ROTOR SPINNING DEVICE

BACKGROUND OF THE INVENTION

This application claims the benefit of German patent application 103 39 875.9 filed Aug. 29, 2003, herein incorporated by reference.

The invention relates to a channel plate for an open-end rotor spinning device.

Open-end spinning devices with a rotor housing open toward the front, which is closed off by means of a so-called channel plate during spinning, are part of the prior art and have been extensively described in numerous protection rights applications.

Channel plates are known in this connection, which are directly integrated into a pivotably seated cover element of the open-end spinning device, as well as channel plates which can be screwed into the cover element. Moreover, channel plates are known which have a central bearing receptacle, in which a channel plate adapter can be easily interchangeably fixed in place.

For example, modern open-end spinning devices have a fiber channel plate integrated into the cover element which, by means of a lip seal, closes off the rotor housing which is charged with an underpressure during the spinning process.

In this case a draw-in roller and an opening roller for the sliver are additionally seated in the cover element, which covers the entire front of the open-end spinning device.

Such a channel plate with an interchangeable channel plate adapter is described relatively extensively in German Patent Publication DE 197 29 192 A1, for example.

The channel plate body substantially consists of an insert body, whose contact face is exactly matched to the shape and the size of the central bearing receiver in the fiber channel plate, as well as of a channel plate tower extending into the spinning rotor when the spinning device is closed. An arresting shoulder with a central bore, in which a small yarn draw-off tube is positioned, is arranged at the rear of the insert body.

Such a channel plate adapter can be fixed in place in a definite manner in the bearing receiver of the fiber channel plate by means of the arresting shoulder, as well as an appropriate locking element, for example a bar spring. The central bore in the insert body also penetrates through the channel plate tower, at whose front face a yarn draw-off nozzle has been fixed in place, which engages the central bore of the channel plate adapter.

Moreover, the channel plate tower has on its shell face the outlet opening of a fiber guide channel, which connects the sliver opening device arranged in the cover element with the spinning rotor in a continuously pneumatically connected manner.

Preferably such channel plate adapters are matched to a definite rotor shape and/or rotor size, so that it is possible under all production conditions to assure a correct sliver feed-in and optimal yarn draw-off. This means that as a rule in case of a batch change, which also requires a spinning rotor change, the channel plate adapter is also exchanged.

The above described channel plate adapters have been in actual use for a long time and have proven themselves to be outstanding in connection with almost all fiber materials and almost all yarn thicknesses.

However, it has been shown that in connection with the spinning of yarns made of polyester, or yarns whose material contains a relatively high proportion of polyester, it is necessary to make some concessions in regard to the number of rotor revolutions of the open-end spinning device, because otherwise the danger of melt spots arises. This means that with the known channel adapter plates it is hardly possible without danger to realize rotor revolutions of more than 100,000 revolutions per minute in connection with yarns with a relatively high proportion of polyester.

SUMMARY OF THE INVENTION

The object of the invention is based on modifying channel plates, or channel plate adapters, which per se are known and have proven themselves, in such a way that an increase of the number of the rotor revolutions, and therefore also an increase of the production output of open-end rotor spinning devices, becomes possible, in particular in connection with the spinning of yarns with a relatively large polyester proportion, without the danger arising that the fibers become heat-damaged.

In accordance with the invention, this object is attained by means of a channel plate for an open-end rotor spinning device for closing off a rotor housing which can be charged with an underpressure during the spinning process, in which a spinning rotor rotates, having a channel plate tower extending into the spinning rotor, in whose shell face the outlet opening of a fiber guide channel is arranged and in whose front side a yarn draw-off nozzle can be fixed. A concavely arched transition surface adjoins a cylindrical part of the shell face, and the channel plate tower has such a diameter at the height of the rotor edge of the spinning rotor that an annular gap of a gap width of maximally 2 mm between the spinning rotor and the channel plate tower results during the spinning process. According to the invention, at most one half of the outlet opening of the fiber guide channel is arranged in the area of the cylindrical shell face, and the remaining part in the arched transition surface. The wall area of the outlet opening remotest from the front side is at a distance in respect to the center longitudinal axis of the channel plate which is at least 0.5 to 3 mm greater than the distance of the wall area, which adjoins the wall area, of the outlet opening in respect to the center longitudinal axis.

An advantageous embodiment of such a channel plate is embodied in two parts and has a central bearing receiver, in which an interchangeable channel plate adapter can be fixed, which has an insert body matched to the bearing receiver, as well as a channel plate tower extending into the spinning cup of the spinning rotor. The channel plate is dimensioned in such a way that it is suitable for spinning rotors which have a rotor groove of a diameter of maximally 30 mm.

The arrangement of at most half of the outlet opening of the fiber guide channel in a cylindrical area of the shell face of the channel plate tower has the advantage that by means of such a configuration of the channel plate tower, in particular by means of the reduction of the distance of the wall areas of the outlet opening of the fiber guide channel adjacent to the front face of the channel plate tower from the center longitudinal axis of the channel plate, the opening angle of the fiber sliding surface and the front area of the shell face of the channel plate tower are increased.

Such an increase of the opening angle positively affects the throughput of air through the fiber guide channel, as well as the feeding of the fiber delivered via the fiber guide channel to the fiber sliding surface.

This means that by means of the embodiment in accordance with the invention the thermal stress on the open-end spinning device is lowered to a degree which is also non-critical for polyester yarns, as well as an improved alignment of the air flow transporting the individual fibers is achieved.

As a whole, the impact of the fibers on the sliding surface of the spinning rotor at an acute angle leads to a gentler feed-in of the fibers.

Moreover, the wall area of the outlet opening farthest removed from the front face of the channel plate tower lies at a clearly greater distance from the center longitudinal axis of the channel plate.

By retaining the channel plate contour in the area back of the outlet opening of the fiber guide channel it is simultaneously effectively prevented that the air flow generated via the fiber guide channel can immediately flow off the front edge of the spinning rotor, and because of this prevents the pneumatically conveyed fibers from being fed onto the fiber sliding surface of the spinning rotor.

Because of the improvement of the course of the flow of the fiber transport air flow it is possible by means of the channel plates modified in accordance with the invention to increase the number of revolutions of the spinning rotor, and therefore the yarn draw-off speed, even in connection with yarns made of polyester or polyester mixtures, without heat damage of the fibers occurring.

The embodiment in accordance with the invention also shows clear advantages when spinning cotton yarn.

For example, in connection with cotton yarn the yarn strength, as well as the spinning stability during the spinning process are increased.

This means that the number of yarn breaks occurring during the spinning process is reduced by up to 30% when using the channel plate in accordance with the invention.

As described, it is provided in a preferred embodiment that the channel plate is designed in two pieces.

This means that the channel plate has a central bearing receiver, in which a channel plate adapter can be interchangeably fixed.

Here, the channel plate adapter consists of an insert body which is matched in shape and size to the bearing receiver of the channel plate, as well as a channel plate tower embodied as already described above.

The above described improvements of the flow conditions also result when employing such a channel plate adapter, provided the channel plate tower was appropriately modified.

This means that appropriate tests have shown that, in connection with channel plate adapters having the modification in accordance with the invention, the greatest yarn draw-off speeds can be achieved, along with high yarn quality.

The advantages are brought to bear in connection with relatively small spinning rotors in particular.

This means that the invention has been shown to be especially advantageous when the diameter of the rotor groove arranged in the rotor cup lies below 30 mm.

BRIEF DESCRIPTION OF THE DRAWINGS

The invention will be explained in greater detail in what follows by means of an exemplary embodiment represented in the drawings.

Shown are in.

DETAILED DESCRIPTION OF THE PREFERRED EMBODIMENT

Figure 1:
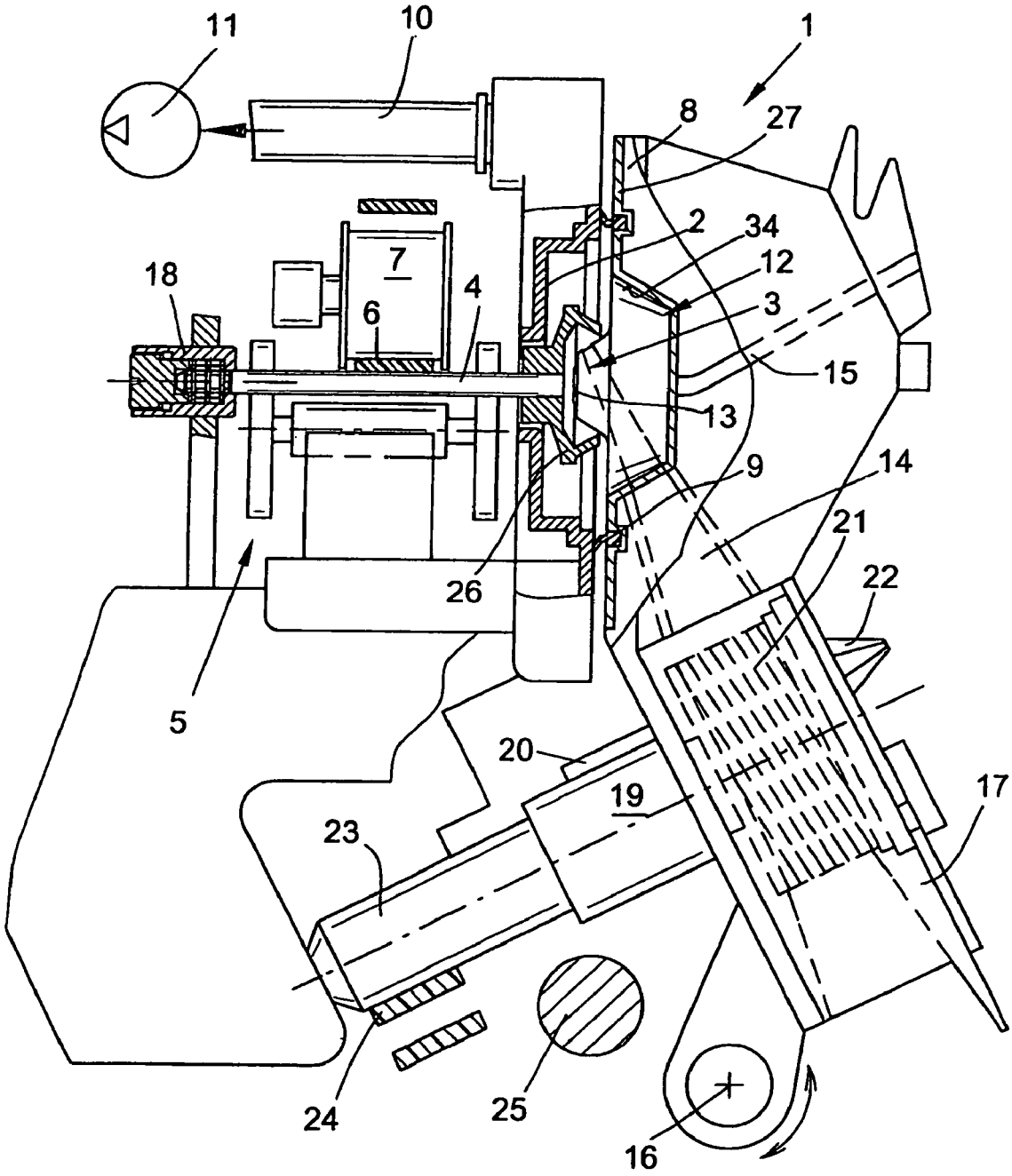
FIG. 1, in a lateral view an open-end spinning device with a channel plate arranged in a cover element, in which a channel plate adapter is interchangeably arranged in a central bearing receiver, FIG. 2, in a lateral view and in a larger scale a channel plate with a channel plate tower modified in accordance with the invention, FIG. 3, in a lateral view and in a larger scale a channel plate in which a channel plate adapter, having a channel plate tower modified in accordance with the invention, is interchangeably arranged in a central bearing receiver, FIG. 4, in a lateral view a channel plate adapter in accordance with the prior art, wherein the outlet opening of a fiber guide channel is shown in a view from above, FIG. 5, in a lateral view a channel plate adapter modified in accordance with the invention with the outlet opening of a fiber guide channel in a view from above, FIG. 5, a front view of a channel plate adapter in accordance with the prior art, FIG. 7, a front view of a channel plate adapter in accordance with the present invention.

The open-end spinning device represented in FIG. 1 has the reference numeral 1 as a whole.

As is known, such spinning devices 1 have a rotor housing 2, in which the spinning cup 26 of a spinning rotor 3 revolves at a high number of revolutions. In accordance with the instant exemplary embodiment, the rotor shaft 4 of the spinning rotor 3 is supported in the bearing nip of a supporting ring bearing 5, which preferably is free of axial thrust. In this case the spinning rotor 3 is driven by a tangential belt 6 extending over the length of the machine, which is pushed against the rotor shaft 3 by a pressure roller 7.

The axial position of the rotor shaft 4 in the bearing nip of the supporting ring bearing 5 is preferably provided by means of a permanent magnet axial bearing 18.

As is customary, the rotor housing 2, which otherwise is open toward the front, is closed during the spinning operation by a pivotably seated cover element 8. To this end the cover element 8 has a channel plate 27 with a seal 9.

The rotor housing 2 is furthermore connected via an aspirating line 10 to an underpressure source 11, which generates the required underpressure in the rotor housing 2.

Figure 3:
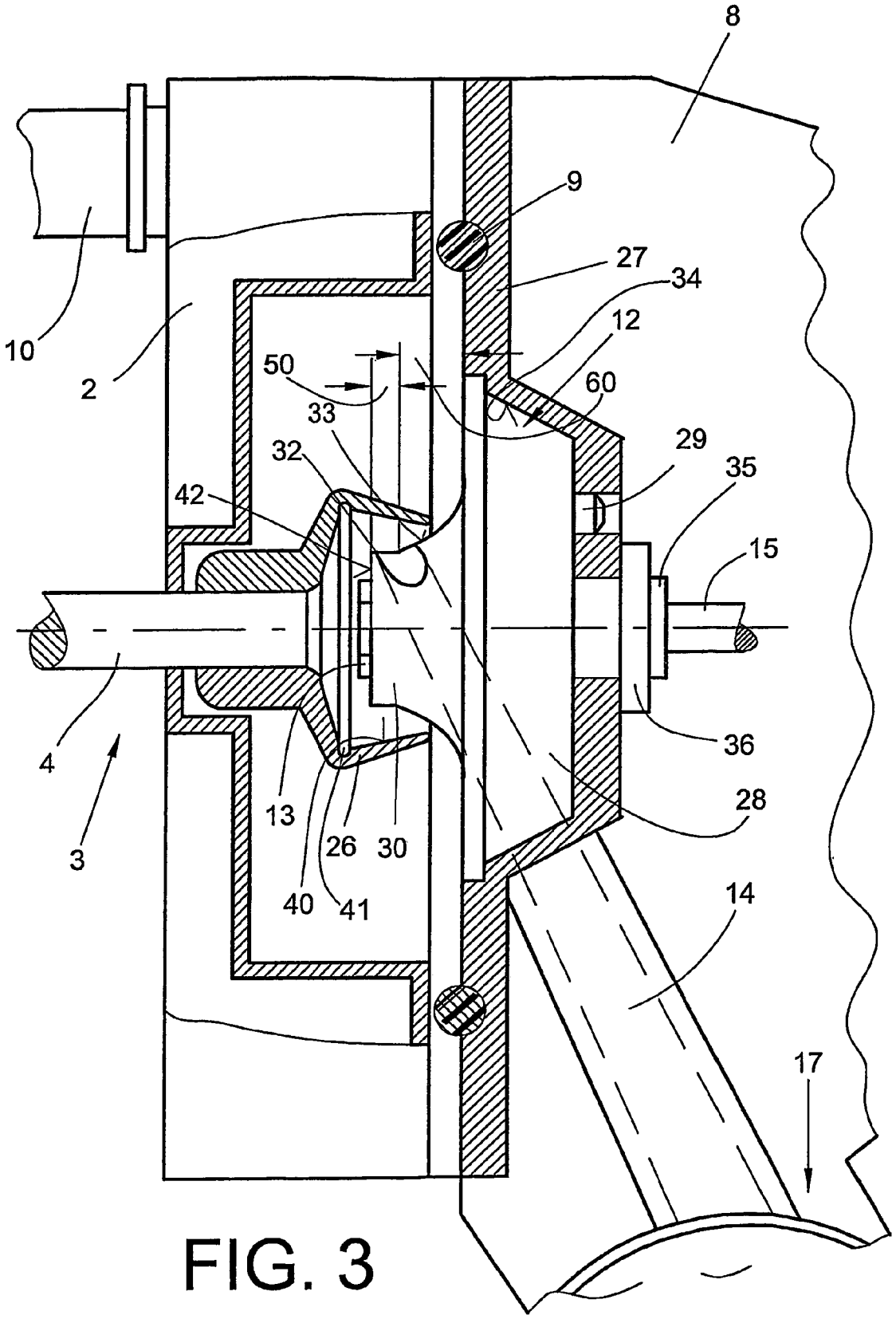

Furthermore, a channel plate adapter 12 is interchangeably arranged in a central bearing receiver 34 of the channel plate 27 which, as shown by way of example in a larger scale in FIG. 3, substantially consists of an insert body 28 with a contact face 37 and a channel plate tower 30.

The outlet opening 31 of a fiber guide channel 14 is arranged in the shell face of the channel plate tower 30, which has a cylindrical area 50 and a concavely arched area 60.

Here it should be expressly stated that the cross-sectional surface of the cylindrical area need not be circular. In accordance with a mathematical definition, a cylindrical area is understood to be a section of the shell face having parallel shell lines.

The channel plate tower 30 furthermore has a central through-bore 38, on the inlet side of which a yarn draw-off nozzle 13 is fixed, and on the outlet side a small yarn draw-off tube 15.

As also shown in FIG. 1, an opening roller housing 17 has been fixed on the cover element 8, or is integrated into the cover element, which element is seated rotatable to a limited extent around a pivot shaft 16.

The cover element 8 furthermore has rear seating consoles 19, 20 for seating an opening roller 21, or of a sliver draw-in cylinder 22.

In the area of its wharve 23, the opening roller 21 is here driven by a revolving tangential belt 24 extending over the length of the machine, while the driving (not represented) of the sliver draw-in cylinder 22 preferably takes place via a worm gear arrangement, which is switched to a drive shaft 25 extending over the length of the machine.

Figure 2:
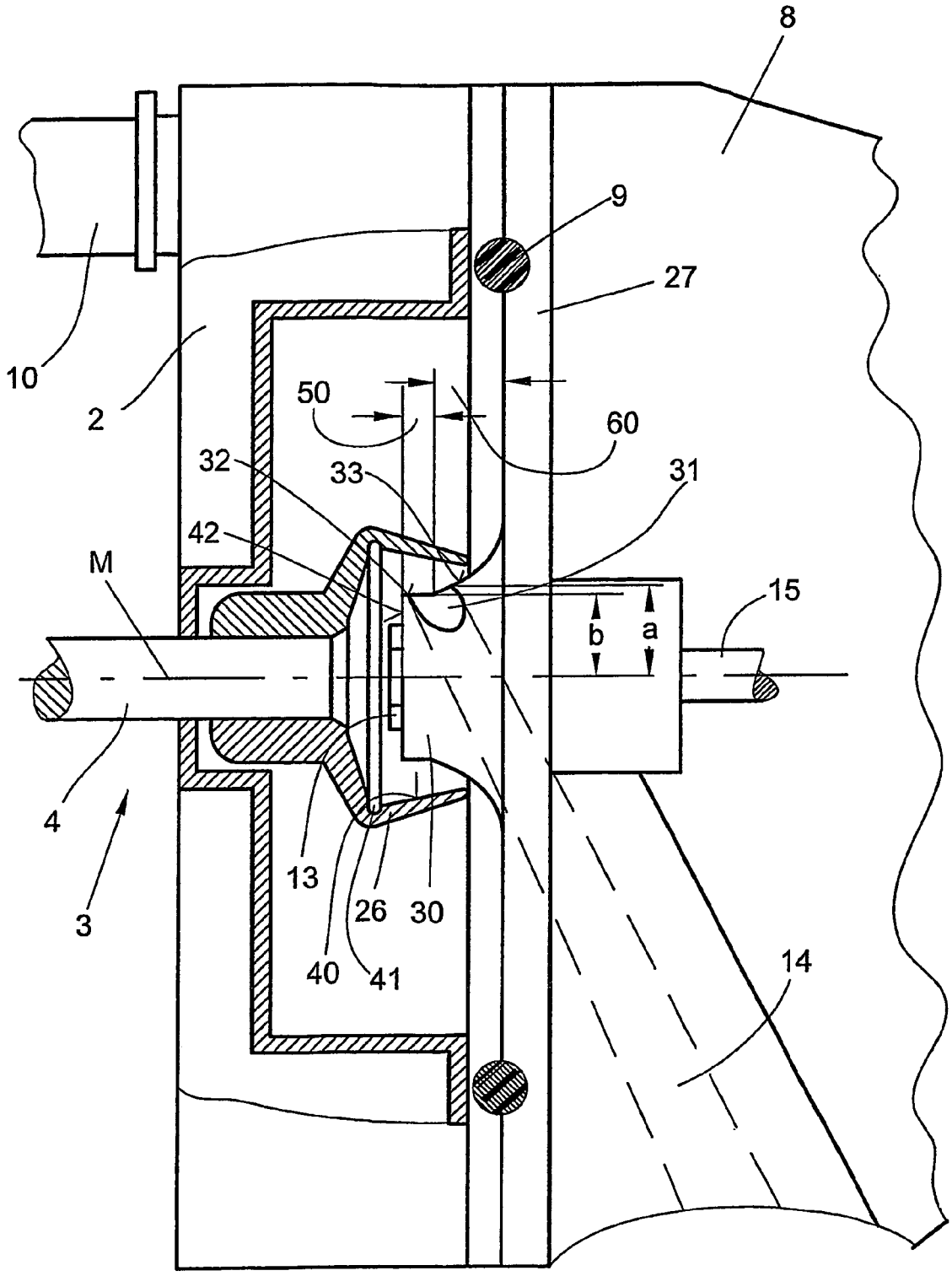

In a larger scale, FIG. 2 shows a channel plate 27 for closing the rotor housing 2 of an open-end spinning device 1.

The channel plate 27 has a channel plate tower 30 modified in accordance with the invention which, with the rotor housing 2 closed, is positioned inside the rotor cup 26 of a spinning rotor 3.

On its front, the channel plate tower 30 has a yarn draw-off nozzle 13 in a through-bore 13, which can be non-positively arrested by means of permanent magnet pins 39. A small yarn draw-off tube 15 is fixed in place on the outlet side of the through-bore 38.

As can be seen, an outlet opening 31 of a fiber guide channel 14, which pneumatically connects the sliver opening device with the rotor housing, is arranged in the area of the shell face of the channel plate tower 30.

In the spinning position, i.e. with the rotor housing 2 closed, the outlet opening 31 of the fiber guide channel 14 lies opposite a fiber sliding surface 40 of the spinning rotor 3 in such a way that the fibers leaving the fiber guide channel 14 are fed to the fiber sliding surface 40 at a relatively acute angle.

The fed-in fibers subsequently pass over the fiber sliding surface 40 into the rotor groove 41 of the spinning rotor 3 where, in a known manner, the formation of a thread takes place, which subsequently is drawn off via the small tube 15.

The diameter of the rotor groove 41 in the rotor cup 26 of the spinning rotor 3 is preferably less than 30 mm here.

Figure 4:
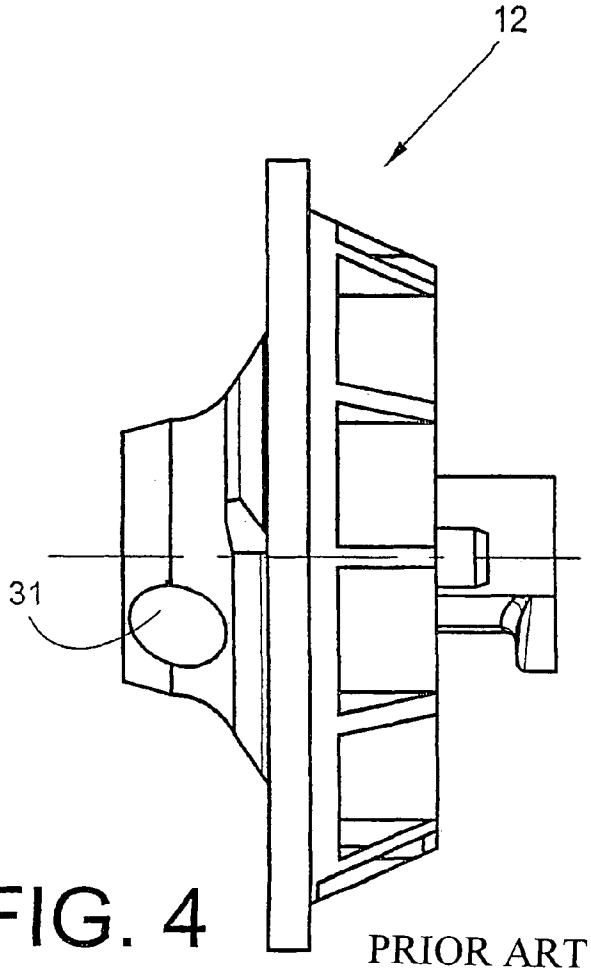
FIG. 4 PRIOR ART
Figures 6, 7:
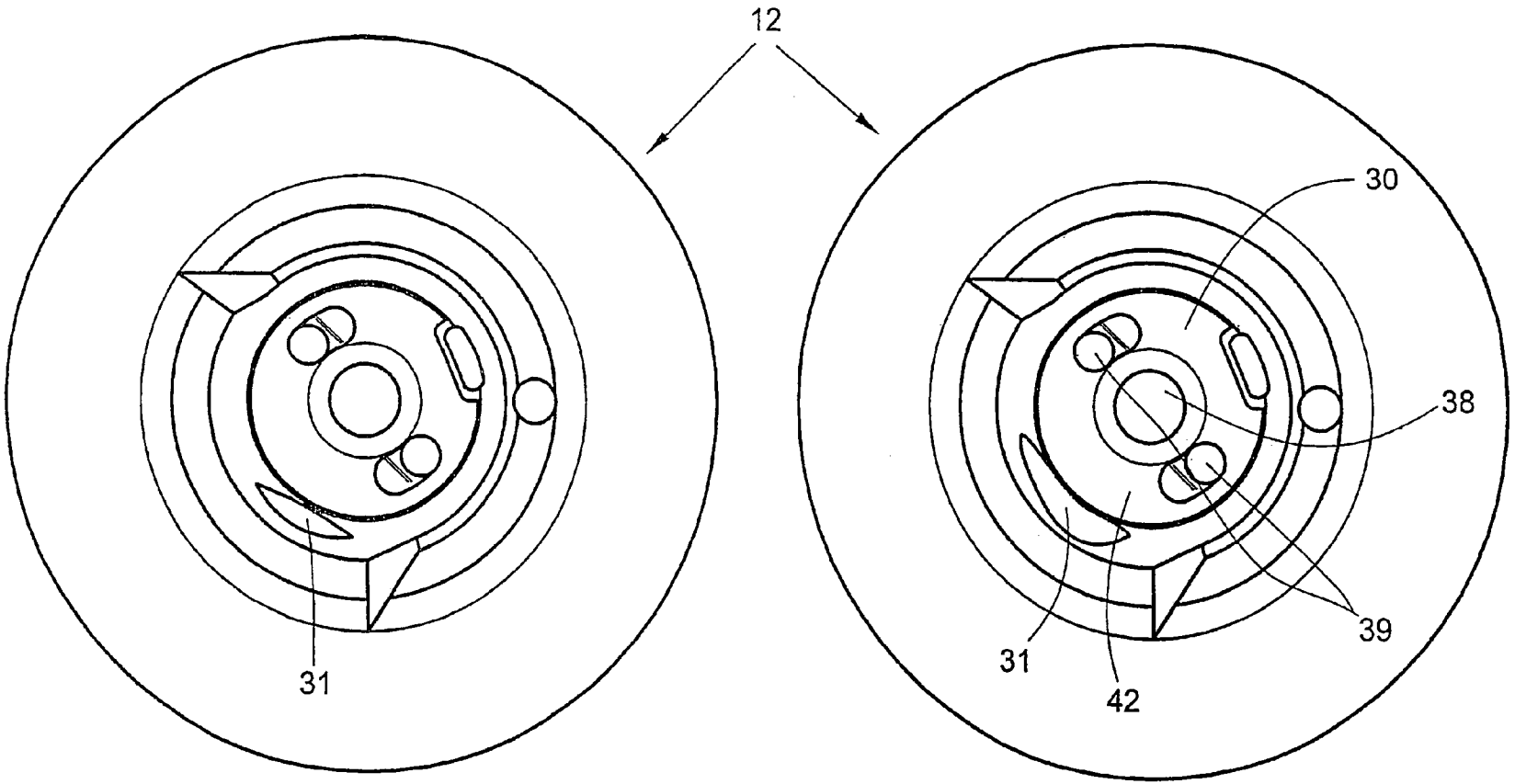
FIG. 6 PRIOR ART

In connection with a channel plate 27 modified in accordance with the invention, or in a channel plate adapter 12 modified in accordance with the invention, the channel plate tower 30 is embodied in contrast to channel plate adapters which were customary so far and are represented in FIGS. 4 and 6 in such a way that the wall area 32 of the outlet opening 31 adjoining the front area 42 of the channel plate tower 30 is lowered in respect to the wall area 33 located behind the outlet opening 31.

This means that preferably the channel plate tower 30 is embodied in such a way that a cylindrical shell surface section 50 in particular has a distance b from the center longitudinal axis M of the channel plate 27, while the distance a in the rear wall area 33 remains unchanged. As a comparison of FIGS. 4, 6 with FIGS. 5, 7 in particular shows, this step leads to a clear increase of the outlet opening 31 of the fiber guide channel 14 in the direction toward the spinning rotor 3.

Figure 5:
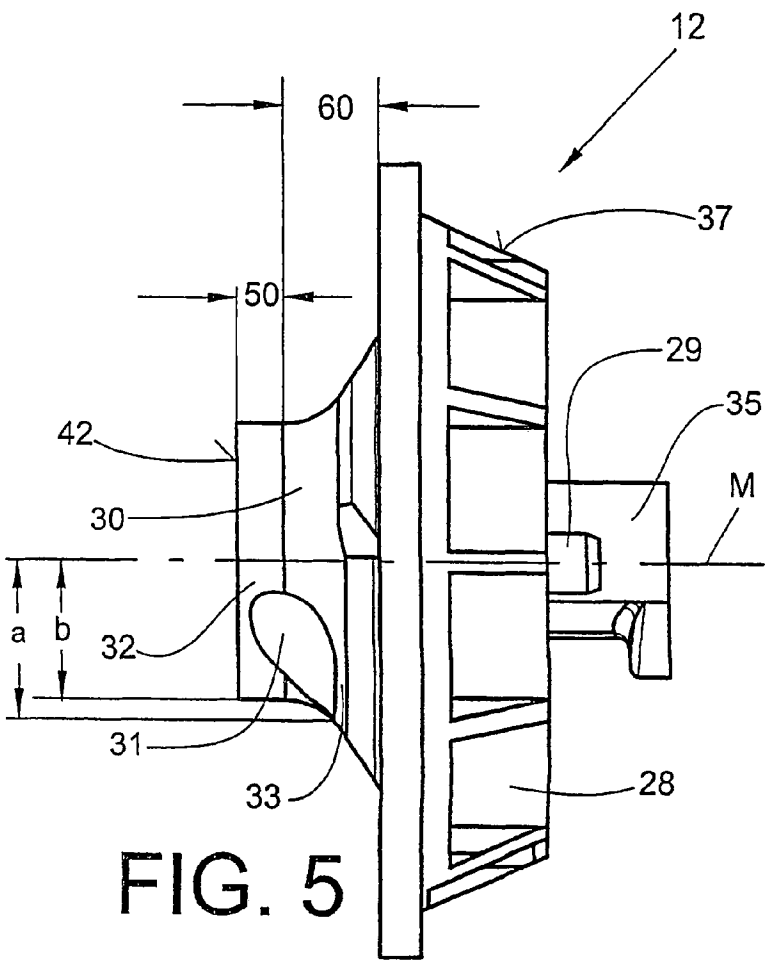

A channel plate adapter 12 with a known channel plate tower is represented in a lateral view or view from above in FIGS. 4 and 6, while FIGS. 5 and 7 show a channel plate adapter 12 with a channel plate tower 30 modified in accordance with the invention.

The invention claimed is:

1. A channel plate for an open-end rotor spinning device for closing off a rotor housing which can be charged with an underpressure during the spinning process, in which a spinning rotor rotates, having a channel plate tower extending into the spinning rotor, in whose shell face the outlet opening of a fiber guide channel is arranged and in whose front side a yarn draw-off nozzle can be fixed, wherein a concavely arched transition surface adjoins a cylindrical part of the shell face, and the channel plate tower has such a diameter at the height of the rotor edge of the spinning rotor that an annular gap of a gap width of maximally 2 mm between the spinning rotor and the channel plate tower results during the spinning process, characterized in that at most one half of the outlet opening (31) of the fiber guide channel (14) is arranged in the area of the cylindrical shell face (50), and the remaining part in the arched transition surface (60), and the wall area (33) of the outlet opening (14) remotest from the front side (42) is at a distance (a) in respect to the center longitudinal axis (M) of the channel plate (12) which is at least 0.5 to 3 mm greater than the distance (b) of the wall area (32), which adjoins the wall area (42), of the outlet opening (31) in respect to the center longitudinal axis (M).

2. The channel plate in accordance with claim 1, characterized in that the channel plate (27) is embodied in two parts and has a central bearing receiver (34), in which an interchangeable channel plate adapter (12) can be fixed, which has an insert body (28) matched to the bearing receiver (34), as well as a channel plate tower (30) extending into the spinning cup (26) of the spinning rotor (3).

3. The channel plate in accordance with claim 1, characterized in that it is dimensioned in such a way that it is suitable for spinning rotors (3) which have a rotor groove (41) of a diameter of maximally 30 mm.

* * * * *